US011733004B2

(12) United States Patent
Fackler et al.

(10) Patent No.: US 11,733,004 B2
(45) Date of Patent: Aug. 22, 2023

(54) SYSTEMS AND METHODS FOR MULTI-ACCESSORY MOUNT ASSEMBLY FOR A FIREARM

(71) Applicant: GBRS Group, Virginia Beach, VA (US)

(72) Inventors: Blair Cole Fackler, Virginia Beach, VA (US); Donald Wayne Shipley, Virginia Beach, VA (US); Slade William Cutrer, Virginia Beach, VA (US)

(73) Assignee: GBRS GROUP LLC, Virginia Beach, VA (US)

( * ) Notice: Subject to any disclaimer, the term of this patent is extended or adjusted under 35 U.S.C. 154(b) by 0 days.

(21) Appl. No.: 17/514,190

(22) Filed: Oct. 29, 2021

(65) Prior Publication Data

US 2023/0135474 A1 May 4, 2023

Related U.S. Application Data

(60) Provisional application No. 63/170,791, filed on Apr. 5, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 5,134,798 A * 8/1992 Lee ..... F41G 11/003 42/114
6,854,206 B2 * 2/2005 Oz ..... F41G 1/35 42/111
6,895,708 B2 * 5/2005 Kim ..... F41G 11/003 42/106
7,240,451 B2 * 7/2007 Blair ..... F41G 11/003 42/124
7,765,730 B2 * 8/2010 Keng ..... F41G 11/003 42/141
D654,134 S * 2/2012 Edge ..... D22/108
RE45,185 E * 10/2014 Davies ..... F41G 11/003 42/71.01

(Continued)

*Primary Examiner* — Michelle Clement
(74) *Attorney, Agent, or Firm* — Eversheds Sutherland (US) LLP

(57) ABSTRACT

A multi-accessory mount assembly for use with a firearm, and methods for coupling the assembly to the firearm are provided. The assembly may include a proximal portion having a lower surface configured to be removably coupled to the firearm and an upper surface configured to be removably coupled to a sub mount. The sub mount may be configured to be removably coupled to a first firearm accessory, e.g., an optic scope, a red dot sight, a reflex sight, a night vision monocular or scope, or a magnifier. The assembly further may include a distal portion extending distally from the proximal portion via a neck portion, such that the distal portion is elevated higher than the proximal portion. An upper surface of the distal portion may be configured to be removably coupled to a second firearm accessory, e.g., an infrared laser or a night vision monocular or scope.

11 Claims, 18 Drawing Sheets

(56) References Cited

U.S. PATENT DOCUMENTS

| | | | | |
|---|---|---|---|---|
| 8,857,096 | B2 * | 10/2014 | McClintock | F41G 11/003 42/72 |
| 9,015,982 | B1 * | 4/2015 | Powers | F41G 11/003 42/124 |
| 9,157,696 | B2 * | 10/2015 | Dextraze | F41C 23/16 |
| 9,441,915 | B2 * | 9/2016 | Zimmer | F41G 11/001 |
| 9,470,480 | B2 * | 10/2016 | Kirchhoff | F41G 11/001 |
| 9,488,446 | B2 * | 11/2016 | Zimmer | F41G 1/02 |
| 9,523,557 | B2 * | 12/2016 | Sharron | F41G 11/003 |
| 9,523,558 | B2 * | 12/2016 | Visinski | F41C 27/00 |
| 9,574,852 | B1 * | 2/2017 | McKillips | F41G 11/003 |
| D787,007 | S * | 5/2017 | Maughn | D22/108 |
| 9,689,646 | B1 * | 6/2017 | Story | F41C 27/00 |
| 9,784,527 | B2 * | 10/2017 | Helms | F41C 23/16 |
| 9,857,142 | B2 * | 1/2018 | Sharron | F41G 11/003 |
| 10,024,632 | B1 * | 7/2018 | Oglesby | F41G 11/003 |
| 10,060,705 | B2 * | 8/2018 | Compton | H04B 5/0031 |
| 10,088,277 | B2 * | 10/2018 | Zimmer | F41G 11/003 |
| 10,101,126 | B2 * | 10/2018 | Sharron | F41G 11/003 |
| 10,101,127 | B2 * | 10/2018 | Visinski | F41G 11/003 |
| 10,119,787 | B2 * | 11/2018 | Geissele | F41G 11/003 |
| 10,151,557 | B2 * | 12/2018 | Sharron | F41C 27/00 |
| 10,352,656 | B2 * | 7/2019 | Ding | F41G 11/004 |
| 10,359,258 | B2 * | 7/2019 | Geissele | F41G 11/003 |
| 10,670,374 | B2 * | 6/2020 | Storch | F41C 27/00 |
| 10,845,162 | B2 * | 11/2020 | Geissele | F41G 11/003 |
| 10,871,344 | B2 * | 12/2020 | Brown, Jr. | F41C 23/04 |
| 10,921,090 | B2 * | 2/2021 | Schatz | F41C 23/16 |
| 11,150,049 | B2 * | 10/2021 | Kennair, Jr. | F41G 11/003 |
| 2006/0059762 | A1 * | 3/2006 | Blair | F41G 11/003 42/124 |
| 2007/0199225 | A1 * | 8/2007 | Haugen | F41G 11/003 42/85 |
| 2011/0000119 | A1 * | 1/2011 | Desomma | F41A 3/66 42/75.02 |
| 2015/0020429 | A1 * | 1/2015 | Savoy | F41G 11/008 42/111 |
| 2015/0253104 | A1 * | 9/2015 | Holland | F41G 11/003 42/71.01 |
| 2016/0363416 | A1 * | 12/2016 | Klotz | F41C 27/00 |
| 2017/0059280 | A1 * | 3/2017 | Fravor | F41G 11/003 |
| 2018/0087875 | A1 * | 3/2018 | Yost | F41G 1/26 |
| 2021/0293512 | A1 * | 9/2021 | Duncan, III | F41G 11/003 |

* cited by examiner

SYSTEMS AND METHODS FOR MULTI-ACCESSORY MOUNT ASSEMBLY FOR A FIREARM

CROSS REFERENCE TO RELATED APPLICATIONS

This application is a non-provisional of and claims the priority benefit of U.S. App. No. 63/170,791 filed Apr. 5, 2021. The entire contents of which are hereby incorporated by reference herein.

FIELD OF THE DISCLOSURE

The disclosure generally relates to a firearm and more particularly relates to systems and methods for a multi-accessory mount assembly for a firearm.

BACKGROUND

Conventional optic scopes, magnifiers, and laser scopes have been used with firearms to facilitate aiming and to improve shooting accuracy. It is with respect to these and other considerations that the disclosure made herein is presented.

SUMMARY

Some or all of the above needs and/or problems may be addressed by certain embodiments of the enhanced, elevated multi-accessory mount assembly for a firearm disclosed herein. The firearm may include a barrel with a muzzle end and a breech end. On the firearm usually positioned above the barrel and between the muzzle end and breech end is a mounting surface to which an optic may be mounted. Such mounting surfaces may include a Picatinny rail or a Weaver rail. According to certain embodiments, the multi-accessory mount assembly may include a proximal portion having a lower surface configured to be removably coupled to the firearm, for example, by attaching to a Picatinny or Weaver rail, and an upper surface configured to be removably coupled to an interchangeable sub mount. The interchangeable sub mount is configured to be removably coupled to one or more first firearm accessories, e.g., an optic scope, red dot sight, reflex sight, night vision monocular/scope, or magnifier. The assembly further may include a distal portion extending distally from the proximal portion via a neck portion, e.g., a goose neck, such that the distal portion is elevated higher than the proximal portion. An upper surface of the distal portion is configured to be removably coupled to a second firearm accessory, e.g., an infrared (IR) laser, or night vision monocular/scope.

Other features and aspects of the multi-accessory mount assembly will be apparent or will become apparent to one with skill in the art upon examination of the following figures and the detailed description. All other features and aspects, as well as other systems, methods, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1A:
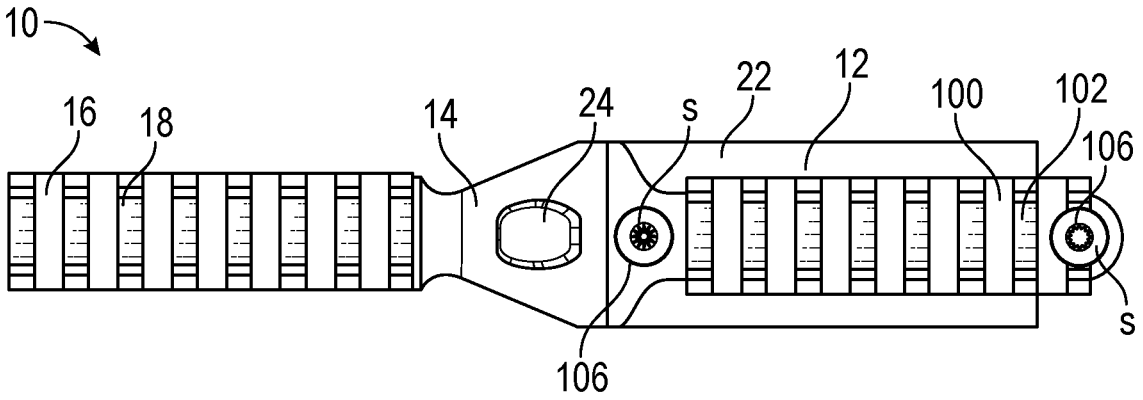
FIG. 1A schematically depicts an upper perspective view of an exemplary multi-accessory mount assembly constructed in accordance with one or more embodiments of the disclosure.

Described below are embodiments of a multi-accessory mount assembly that can be attached to a firearm. Methods of installing the multi-accessory mount assembly on the firearm are also disclosed. The firearm may include a barrel with a breech end and a muzzle end. In some instances, the firearm may be a rifle (e.g., fully automatic, semi-automatic or bolt-action), pistol, shotgun, or the like. In some instances, the firearm may be a rifle, such as an M-16 style rifle, an AR-15 style rifle, an AR-10 style rifle, or an M-4 style rifle, among others that include a Picatinny or Weaver rail positioned above the barrel. Any firearm may be used in association with the firearm sight disclosed herein.

The multi-accessory mount assembly of the present disclosure solves several problems that military, law enforcement, first responders and civilians have encountered when using an IR laser on a rifle. A multi-accessory mount assembly in accordance with the present disclosure includes a base with an elevated mount, and sub mounts that attach to the base. For example, the sub mounts may be interchangeable. The multi-accessory mount assembly moves the position of the IR laser/illuminator to the approximate center of the rifle (e.g., approximately over the action), and elevates the IR laser/illuminator to avoid the IR emission from the IR laser/illuminator being blocked or obscured by the user's hand should the user hold the rifle with their support (or off) hand gripping the handguard. The interchangeable sub mount removably attaches to an optic, such as one or more of a scope, red dot, reflex sight, magnifier or the like. The interchangeable sub mount positions the optic so that it sufficiently clears the IR laser so as not to impede the operability of the optic. Because the sub mount is interchangeable, it may be sized for different optics, and/or for multiple components, such as a red dot/reflex sight and a magnifier. The sub mount attaches to the base in a fitted fashion so that the optic returns to zero if the sub mount is removed from the base and then subsequently reattached. The multi-accessory mount assembly frees up rail space on the firearm platform, balances the weight to center mass over the firearm, and provides a near co-witnessed and unobstructed path for the laser/illuminator to be mounted rearward of the support arm of the shooter/operator.

Certain embodiments of the multi-accessory mount assembly are designed to be modular and perfectly complements superior shooting stances and body mechanics, while capitalizing on reduced fatigue (e.g., heads up versus hunched positions) while shooting, thus allowing proper body mechanics and positioning. The multi-accessory mount assembly further allows the operator to utilize modern and mission critical head-borne systems and personal protective equipment (PPE), e.g., helmets, night vision, gasmasks, communications equipment, body armor, face wraps, etc., and aids in shoulder transitions for offhand shooting and cross eye dominant individuals. The multi-accessory mount assembly is designed to be modular and scalable, and may accept multiple optics system configurations. The assembly further may include a space to mount a magnifier behind the day optic.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

Referring now to FIGS. 1A to 1E, an exemplary multi-accessory mount assembly is provided. Multi-accessory mount assembly 10 may include proximal portion 12, neck portion 14, and distal portion 16. Distal portion 16 extends from proximal portion 12 via neck portion 14. Moreover, neck portion 14 may be angled such distal portion 16 is elevated higher than proximal portion 12. As shown in FIG. 1A, neck portion 14 may include cut outs 24 to reduce the weight of the multi-accessory mount assembly. In some embodiments, cut outs 24 may extend horizontally through neck portion 14.

Proximal portion 12 has lower surface 20 and upper surface 22. Lower surface 20 is configured to be removably coupled to a firearm. In some instances, the firearm may be a conventional and/or tactical, and may be a rifle, pistol, shotgun or the like. However, the firearm may be any number of firearms, such as, but not limited to, an M-16 style rifle, an AR-15 style rifle, an AR-10 style rifle, or an M-4 style rifle, or the like with a rail system, such as a Picatinny rail or a Weaver rail. The firearm may generally include a barrel and a muzzle end. Proximal portion 12 may include one or more screws/knobs 28 for facilitating attachment of proximal portion 12 to the rail system of the firearm, e.g., the Picatinny rail or the Weaver rail.

Distal portion 16 has an upper surface configured to be removably coupled to a firearm accessory, e.g., an IR laser/illuminator. The upper surface of distal portion 16 may include rail system 18 to facilitate coupling with the firearm accessory. For example, rail system 18 may include a Picatinny rail or a Weaver rail. Distal portion 16 may be elevated from the rail system of the firearm a predetermined height when proximal portion 12 is coupled to the rail system of the firearm, thereby creating a space sized and shaped to permit the support hand of the operator of the firearm to grip the handguard without interfering with the use of the firearm accessory.

Upper surface 22 of proximal portion 12 may be configured to be removably coupled to an interchangeable sub mount, e.g., interchangeable sub mount 100. For example, upper surface 22 may include one or more apertures 26, e.g., threaded apertures, for receiving screws that pass through corresponding apertures in interchangeable sub mount 100 to tightly secure the interchangeable sub mount. For example, upper surface 22 may include a threaded aperture at a proximal region and another threaded aperture at a distal region. Accordingly, interchangeable sub mount 100 may include a corresponding number of apertures 106, e.g., threaded apertures, such that apertures 106 may be aligned with apertures 26 of proximal portion 12.

Figure 1B:
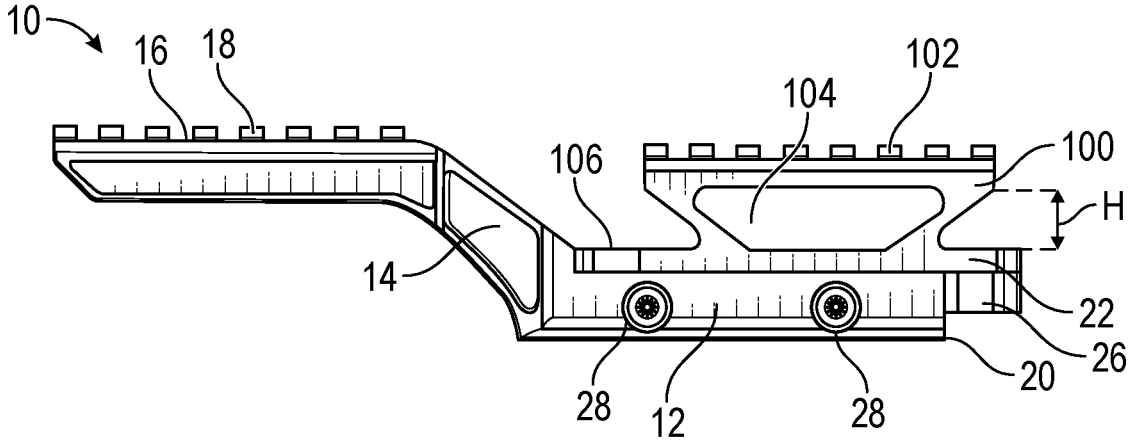
FIG. 1B illustrates a side perspective view of the multi-accessory mount assembly of FIG. 1A.
Figure 1C:
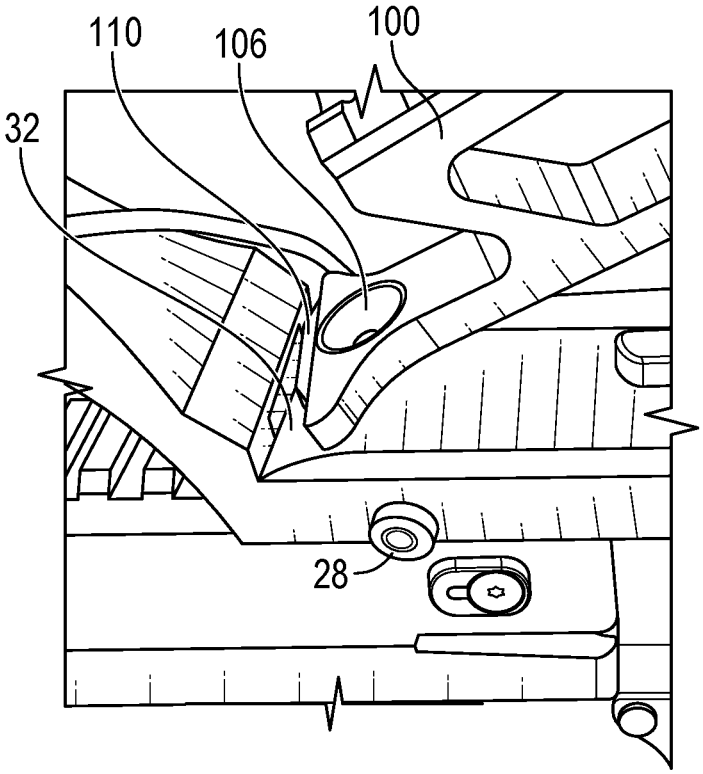
FIGS. 1C to 1E illustrate the steps of coupling a sub mount to a proximal portion of the multi-accessory mount assembly in accordance with one or more embodiments of the disclosure.
Figure 1D:
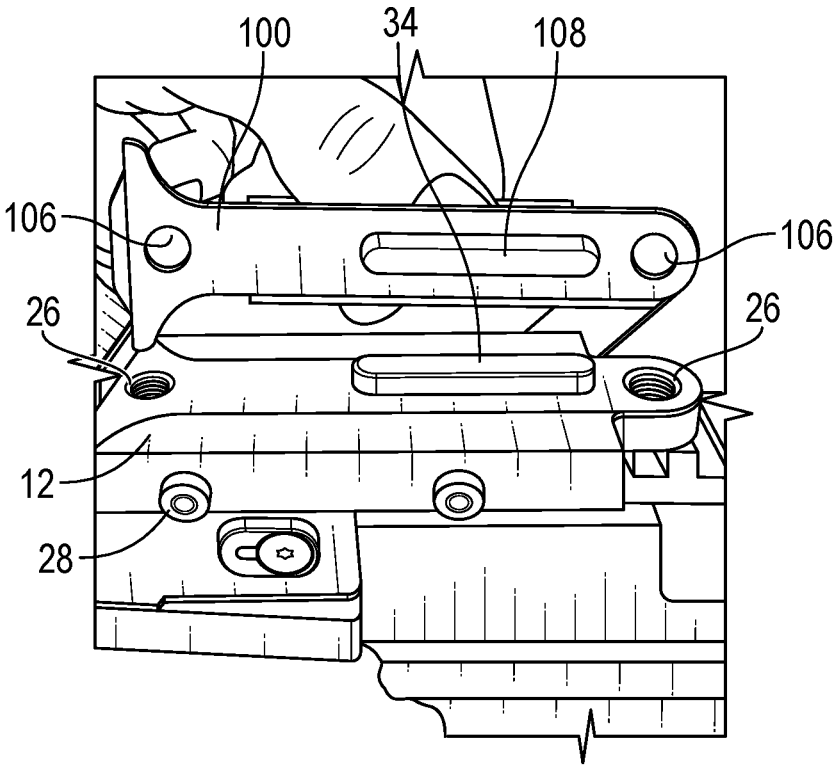
Figure 1E:
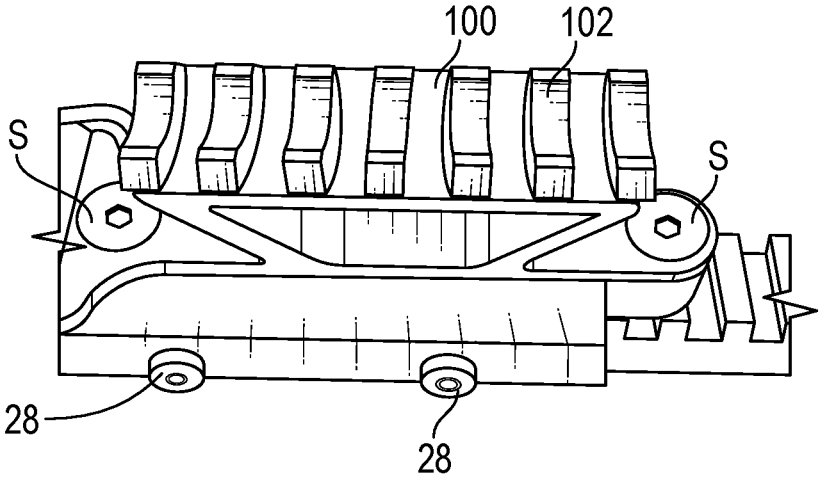

As shown in FIG. 1C, proximal portion 12 may include position reference features that ensure exact repositioning of interchangeable sub mount 100 relative to the proximal portion 12. An example system of position reference features includes groove 32 sized and shaped to receive and mate with ridge 110 of interchangeable sub mount 100. In addition, as shown in FIG. 1D, interchangeable sub mount 100 may include groove 108 sized and shaped to receive and mate with protrusion 34 of proximal portion 12. Accordingly, interchangeable sub mount 100 may be removably coupled to proximal portion 12 such that groove 32 mates with ridge 110, groove 108 mates with protrusion 34, and apertures 106 are aligned with apertures 26, as shown in FIG. 1E. Upon alignment, a fastener, e.g., screws S, may be used to couple interchangeable sub mount 100 with proximal portion 12 via apertures 26 and 106, as shown in FIG. 1F. Screws S may fit through cutouts in the Picatinny rail, if necessary, which function as extensions of apertures 106 and 26. With this mounting system for interchangeable sub mount 100, interchangeable sub mount 100 can be repeatedly removed and re-installed, and return to zero each time.

The upper surface of interchangeable sub mount 100 may be configured to be removably coupled to one or more firearm accessories, e.g., one or more of a red dot, reflex sight, scope, IR or thermal scope/monocular, or a magnifier. The term "optic" will be used herein to describe collectively an optic or an optic mount. The upper surface of interchangeable sub mount 100 may include a rail system 102 to facilitate coupling with the firearm accessory. For example, protrusions 102 may include a Picatinny rail or a Weaver rail. Moreover, interchangeable sub mount 100 may include opening 104 for weight reduction of interchangeable sub mount 100. As shown in FIG. 1B, height H of the upper surface of interchangeable sub mount 100 may be predetermined based on, for example, the desired height of the optic for the shooter and/or the attached optic so that it is operable over the firearm accessory attached to distal portion 16. For example, some optics are shorter (e.g., distance from bottom surface of the optic to reticle) than other optics, and they may require a relatively taller interchangeable sub mount so the reticle of the optic is viewable on target over the firearm accessory.

Figure 2A:
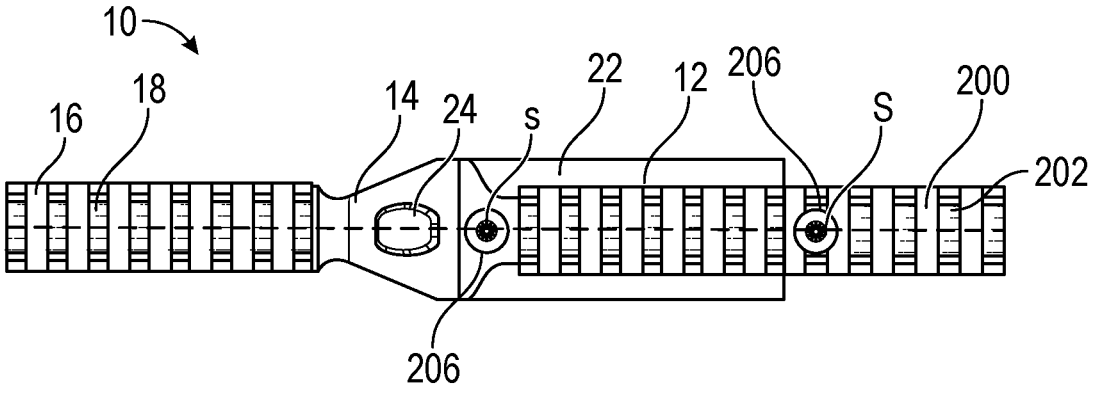
FIG. 2A illustrates an upper perspective view of another exemplary multi-accessory mount assembly constructed in accordance with one or more embodiments of the disclosure.
Figure 2B:
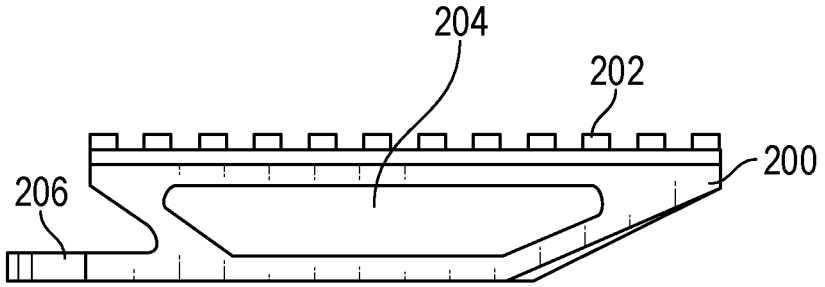
FIG. 2B illustrates a side perspective view of the interchangeable sub mount of FIG. 2A.

Referring now to FIGS. 2A and 2B, an alternative exemplary interchangeable sub mount for coupling with multi-accessory mount assembly 10 is provided. Interchangeable sub mount 200, as shown in FIG. 2B, may be constructed and coupled to proximal portion 12 similar to interchangeable sub mount 100. For example, rail system 202 corresponds with rail system 102, opening 204 corresponds with opening 104, and one or more apertures 206 correspond with one or more apertures 106. Interchangeable sub mount 200 differs from interchangeable sub mount 100 in that interchangeable sub mount 200 may have a longer longitudinal length than interchangeable sub mount 100, and consequently can have two or more firearm accessories attached to it, such as a red dot/reflex sight and a magnifier or a thermal or IR scope or monocular. Accordingly, the operator of the firearm may select between interchangeable sub mounts 100 and 200 based on the desired firearm accessory (ies) to be coupled to the firearm.

Figure 3:
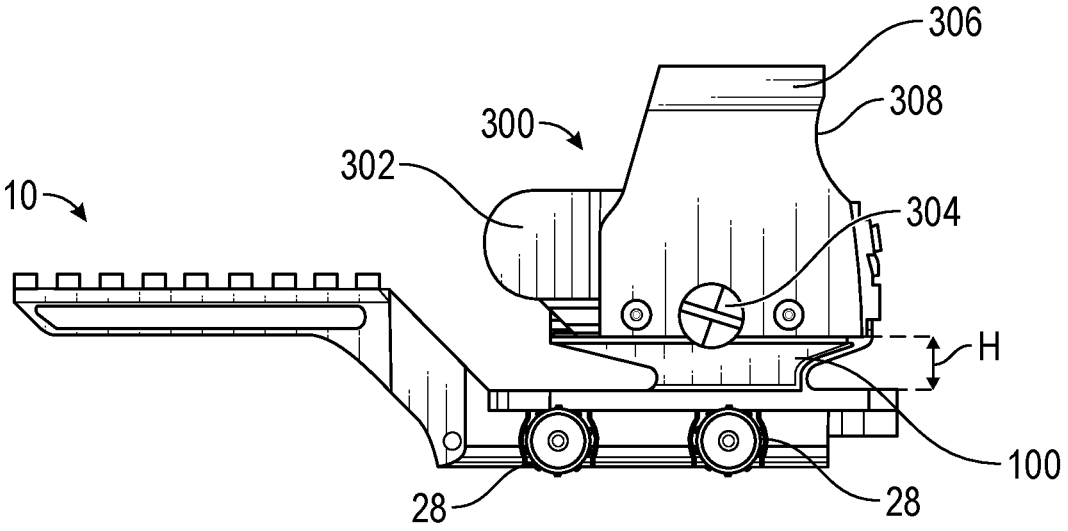
FIG. 3 illustrates a view of an exemplary multi-accessory mount assembly coupled to an exemplary optic in accordance with one or more embodiments of the disclosure.

Referring now to FIG. 3, coupling multi-accessory mount assembly 10 to an optic is described. Optic 300 may be removably coupled to an upper surface of the interchangeable mount, e.g., interchangeable sub mount 200, such that optic 300 is positioned at a height H. Optic 300 may include base 302 and lens holder 306 for holding lens 308. Moreover, optic 300 may include knob 304 which may be actuated to fix optic 300 to the interchangeable sub mount 100.

Figure 4:
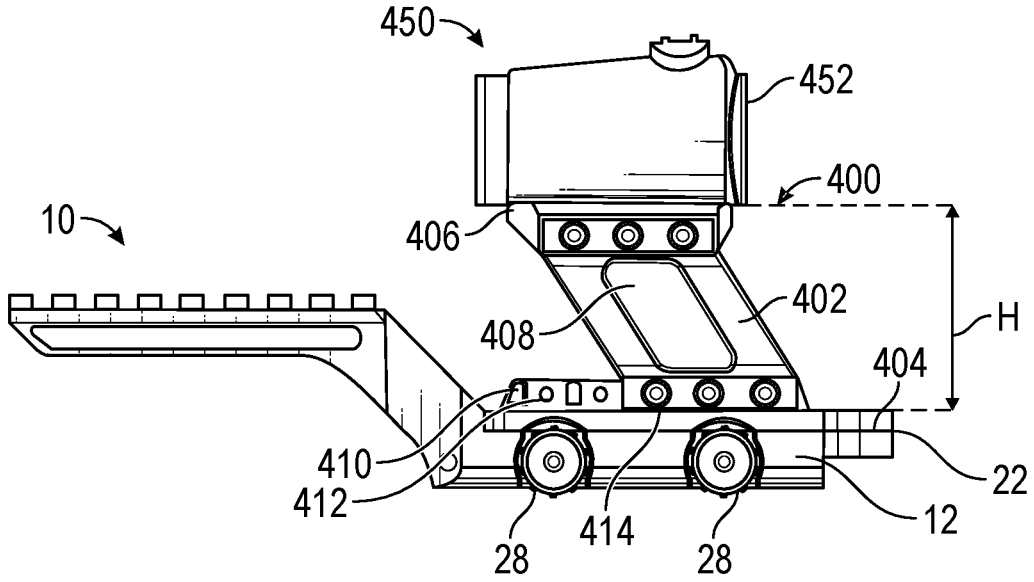
FIG. 4 illustrates a view of an exemplary multi-accessory mount assembly coupled to an exemplary optic in accordance with one or more embodiments of the disclosure.

Referring now to FIG. 4, coupling multi-accessory mount assembly 10 to optic 450 via interchangeable sub mount 400, which is adjustable, is described. Interchangeable sub mount 400 may be constructed similar to interchangeable sub mounts 100 and 200 described above. For example, lower surface 404 of interchangeable sub mount 400 may be configured to be removably coupled to upper surface 22 of proximal portion 12, e.g., via screw S, and upper surface 406 of interchangeable sub mount 400 may be configured to be removably coupled to a firearm accessory, e.g., optic 450. Moreover, upper surface 406 may extend from lower surface 404 via middle portion 402, which may have opening 408. Unlike interchangeable sub mounts 100 and 200, as shown in FIG. 4, interchangeable sub mount 400 may have a parallelogram shape such that upper surface 406 is positioned distal to lower surface 404. Accordingly, middle portion 402 may be angled.

In addition, the lower portion of interchangeable sub mount 400 may include rail system 412, which may be fixed to proximal portion 12, such that middle portion 402 is slidably movable relative to rail system 410. Accordingly, rail system 410 may include threaded apertures for aligning with the threaded apertures of proximal portion 12, and for receiving screw S, such that rail system 410 may be fixed relative to proximal portion 12. As shown in FIG. 4, rail system 410 may include a plurality of openings 412 configured to engage with pins/knobs 414 (e.g., a screw), such that pins/knobs 414 may be disengaged with openings 412 to permit middle portion 402 to be moved along rail system 410 to a desired longitudinal position, and pins/knobs 414 may engage with openings 412 to lock middle portion 402 in the desired longitudinal position relative to rail system 410 and proximal portion 12.

Optic 450 may be removably coupled to upper surface 406 of interchangeable sub mount 400. Moreover, optic 450 may have one or more knobs for controlling operation of optic 450. When multi-accessory mount assembly 10 is coupled to both optic 450 via interchangeable sub mount 400 and IR laser/illuminator 350, optic 450 is raised by height H.

Figure 5:
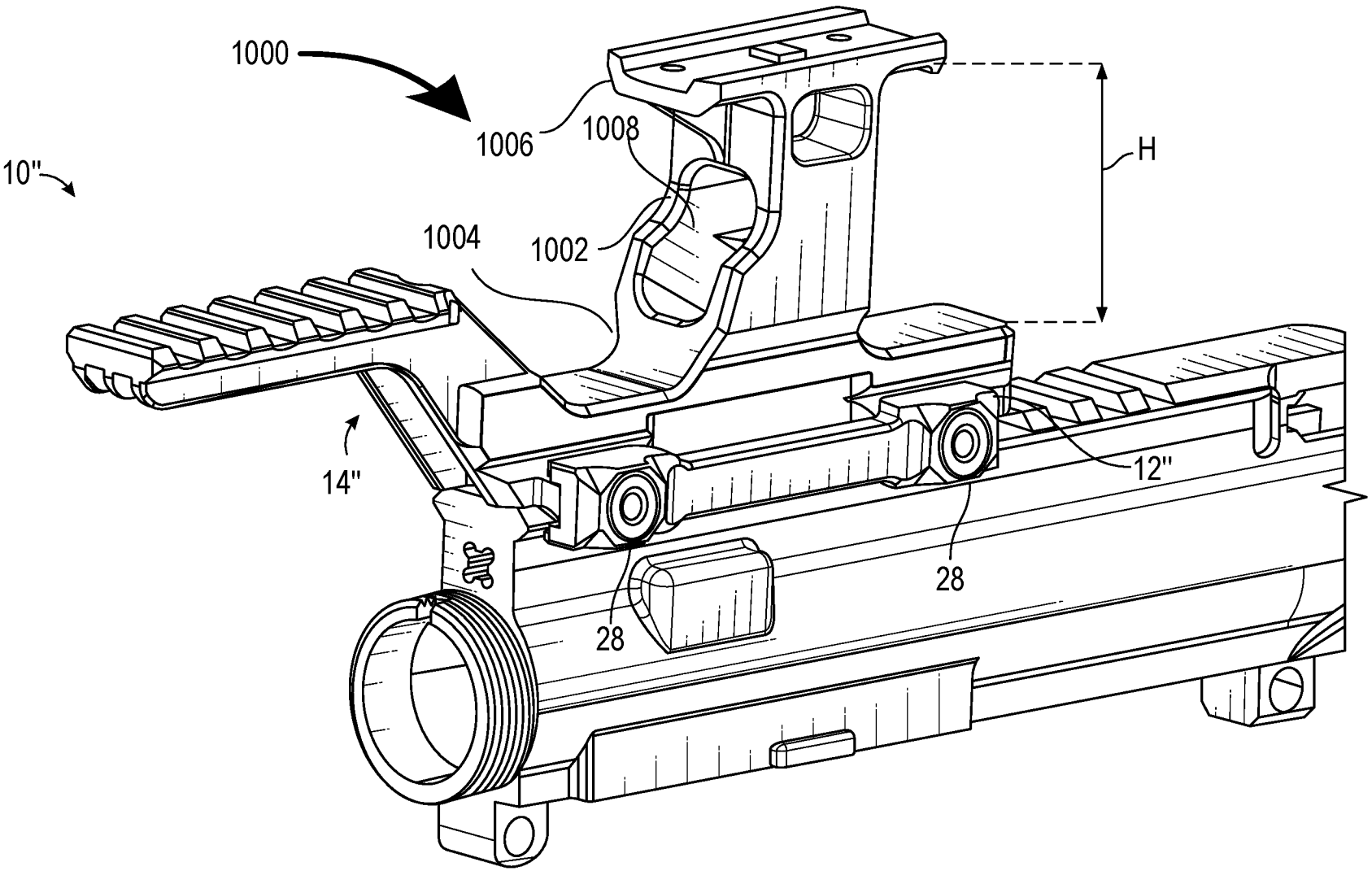
FIG. 5 illustrates a view of an exemplary one-piece multi-accessory mount assembly in accordance with one or more embodiments of the disclosure.

FIG. 5 is a perspective view of an exemplary multi-accessory mount assembly where the sub mount is integrally formed with the proximal portion of the multi-accessory mount assembly, e.g., as a single piece. In such a configuration, sub mount 1000 portion is not interchangeable, but fixed with the rest of the multi-accessory mount assembly. This configuration also may allow for an optic to be above a laser such that the laser does not block the firearm operator's vision of the optic reticle on the target. Further, the one-piece design may provide stability and be configured to allow for mounting of a single type of optic. As shown in FIG. 5, upper portion 1006 of sub mount 1000 may extend from lower portion 1002 via middle portion 1004. Middle portion 1004 may contain serrations on the front or rear. Moreover, sub mount 1000 may have a tapered shape such that the width of middle portion 1004 decreases from lower portion 1002 toward upper portion 1006. For example, a proximal side of middle portion 1004 may extend vertically, whereas a distal side of middle portion 1004 may be angled.

As shown in FIG. 5, multi-accessory mount assembly 10" may be constructed similar to multi-accessory mount assembly 10, with similar components having like prime reference numerals. For example, proximal portion 12" corresponds with proximal portion 12, neck portion 14" corresponds with neck portion 14, and distal portion 16" corresponds with distal portion 16. Multi-accessory mount assembly 10' differs from multi-accessory mount assembly 10 in that multi-accessory mount assembly 10" is one-piece with the proximal portion 12", neck portion 14", and distal portion 16", as described in further detail above.

Figure 6A:
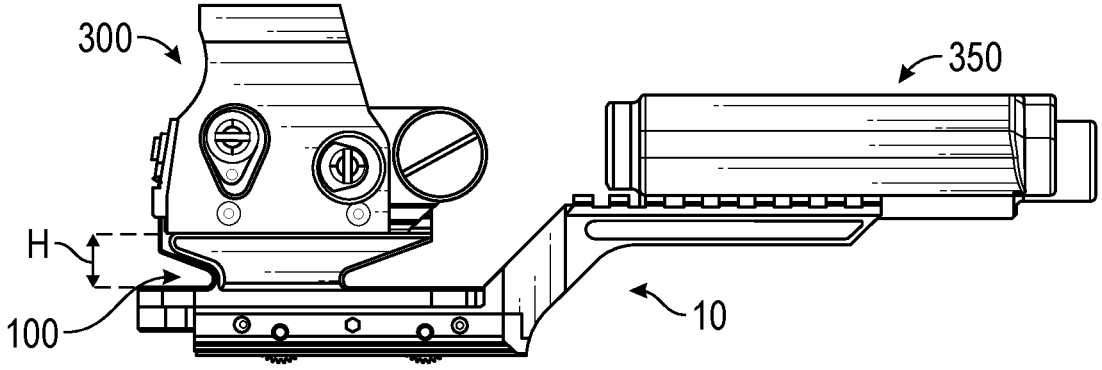
FIG. 6A illustrates a side view of a multi-accessory mount assembly coupled to an optic and a laser in accordance with one or more embodiments of the disclosure.
Figure 6B:
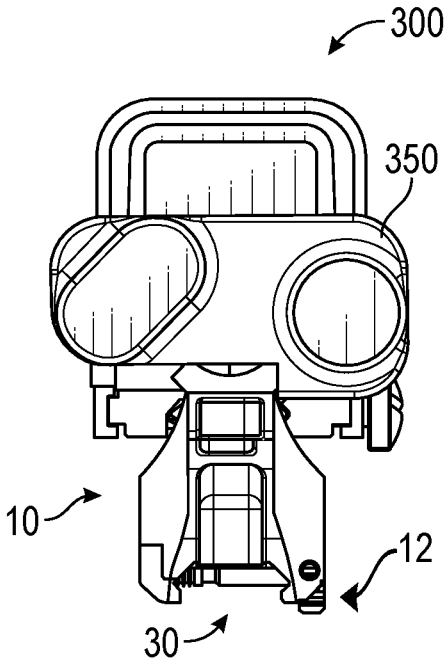
FIG. 6B illustrates a rear view of the multi-accessory mount assembly of FIG. 6A.

FIG. 6A is a side view of multi-accessory mount assembly 10 coupled to both optic 300 via interchangeable sub mount 100, and to laser 350. FIG. 6B is a rear view of multi-accessory mount assembly 10 coupled to optic 300 via interchangeable sub mount 100 and to laser 350. Height H allows for optic 300 to be visible above laser 350. As shown in FIG. 6B, lower surface 20 of proximal portion 12 may include channel 30 sized and shaped to engage with the rail mechanism of the firearm, e.g., at the middle region of the firearm (e.g., approximately over the action), via screws/knobs 28. The line of sight through optic 300 may be above IR laser 350, being raised by height H, such that IR laser 350 does not block the firearm operator's vision of the optic reticle on the target.

Figure 6C:
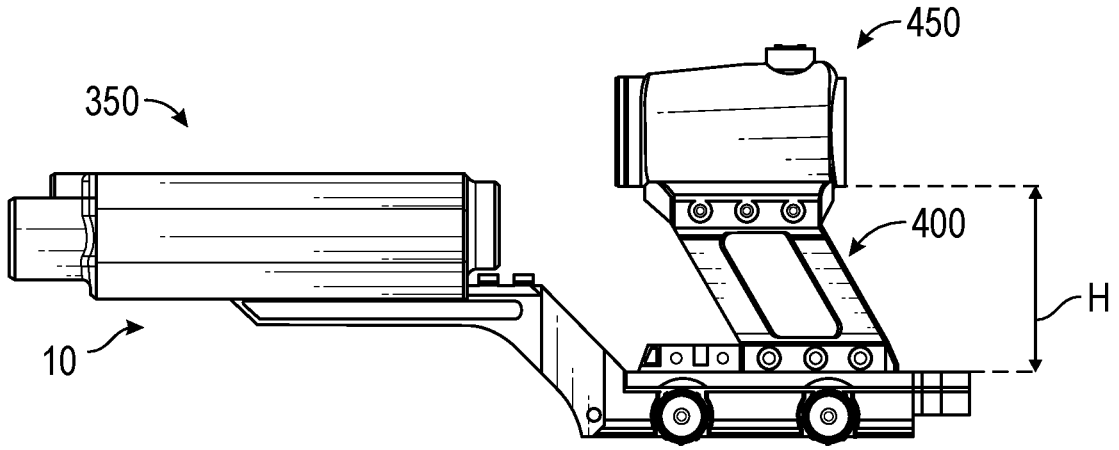
FIG. 6C illustrates a side view of a multi-accessory mount assembly coupled to an optic and a laser in accordance with one or more embodiments of the disclosure.
Figure 6D:
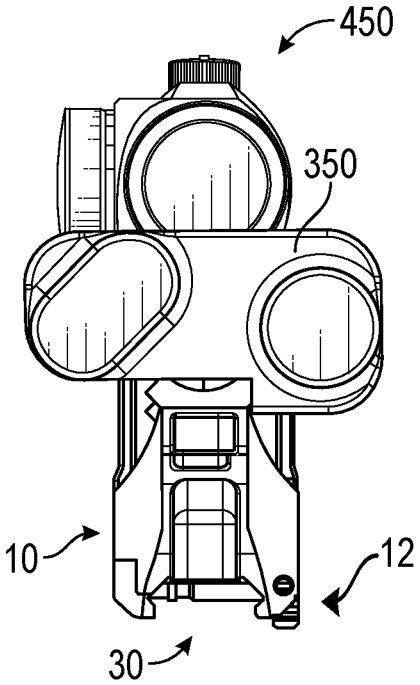
FIG. 6D illustrates a rear view of the multi-accessory mount assembly of FIG. 6C.

FIG. 6C is a side view of multi-accessory mount assembly 10 coupled to both optic 450 via interchangeable sub mount 400, and to laser 350. As will be understood by a person having ordinary skill in the art, any of the firearm accessories described above may be interchangeably coupled to multi-accessory mount assembly 10, and multi-accessory mount assembly 10 further may be removably coupled to other known firearm accessories. FIG. 6D is a rear view of multi-accessory mount assembly 10 coupled to optic 450 via interchangeable sub mount 400 and to laser 350. The height H allows for optic 450 to be visible above the laser 350. As shown in FIG. 6D, the reticle of optic 450 may be visible on target above IR laser/illuminator 350, such that laser 350 does not block the firearm operator's vision of the optic reticle on the target.

Figure 7A:
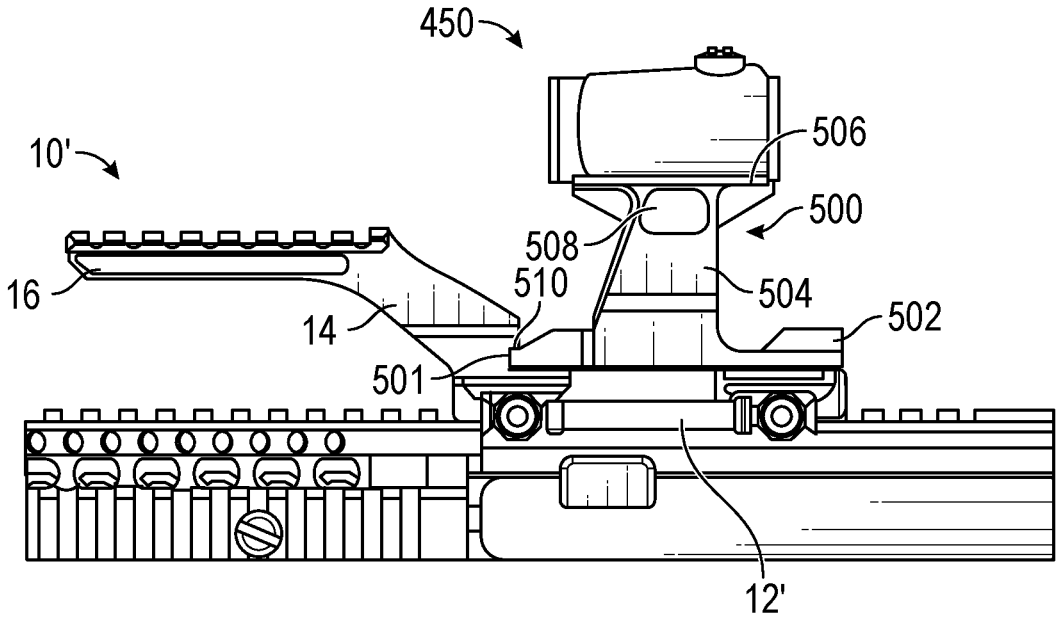
FIGS. 7A to 7E illustrate various views of another exemplary multi-accessory mount assembly coupled to another exemplary optic in accordance with one or more embodiments of the disclosure.
Figure 7B:
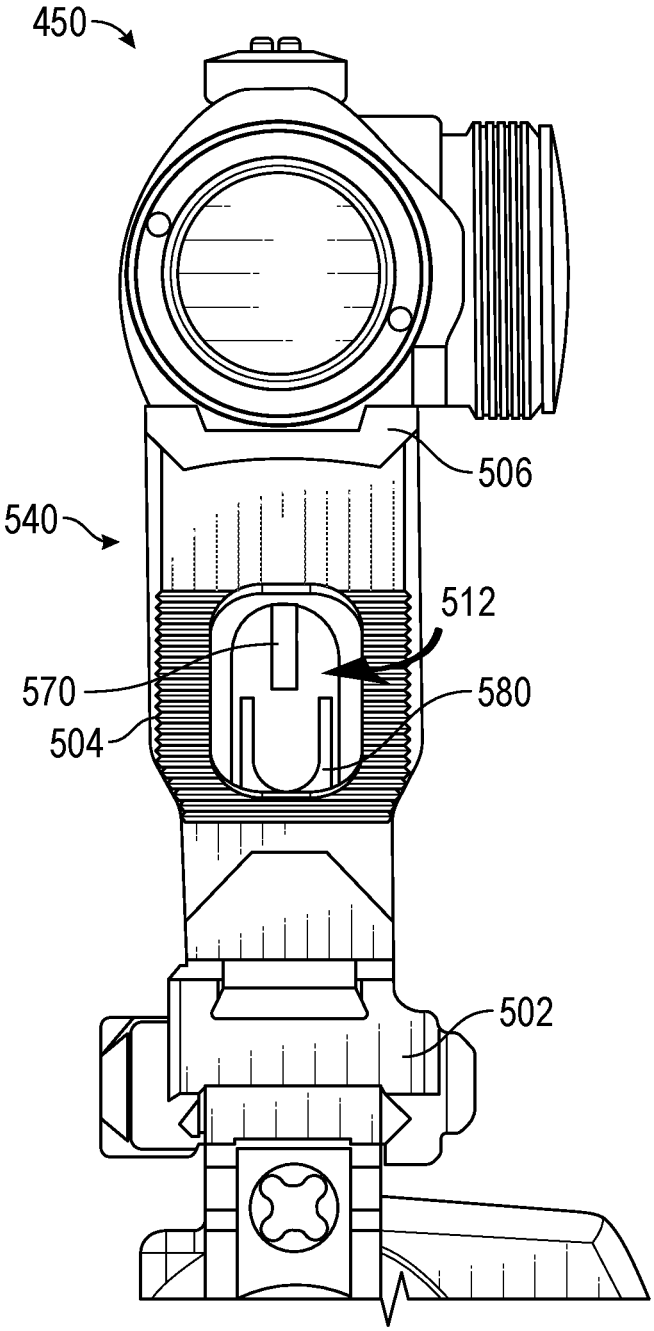
Figure 7C:
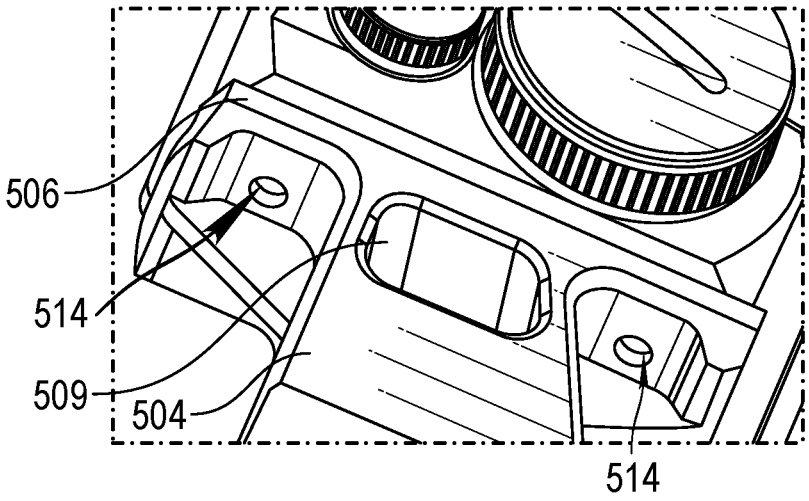
Figure 7D:
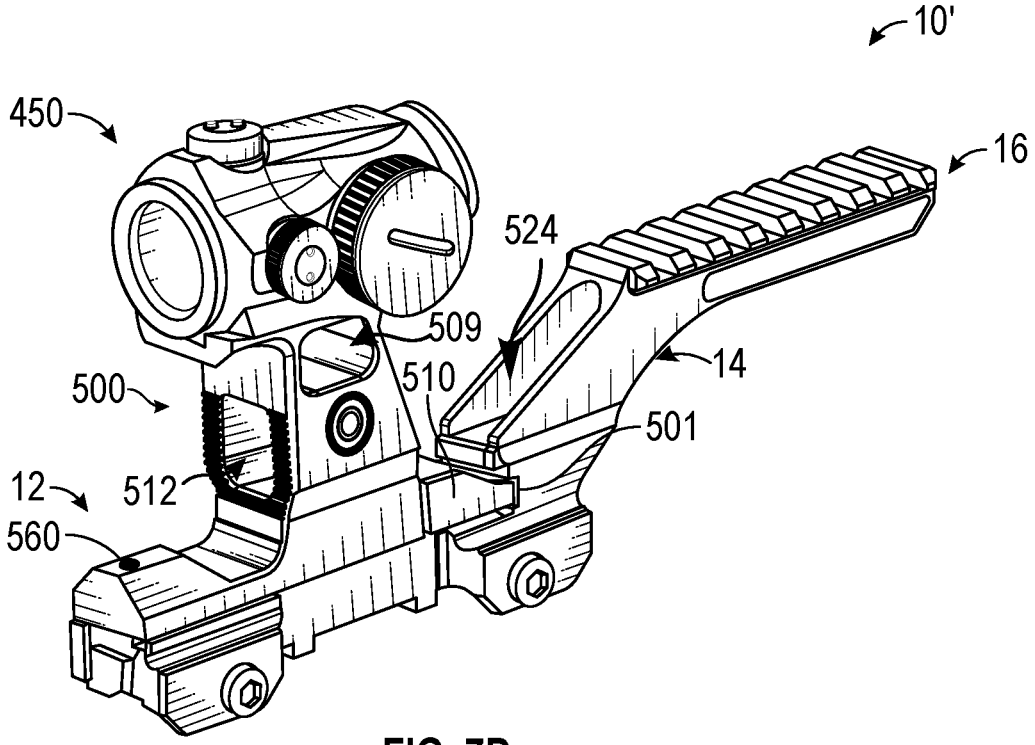

Referring now to FIGS. 7A to 7E, an alternative exemplary interchangeable sub mount for coupling with an alternative exemplary multi-accessory mount assembly is provided. Multi-accessory mount assembly 10' may be constructed similar to multi-accessory mount assembly 10, with similar components having like-prime reference numerals. For example, proximal portion 12 corresponds with proximal portion 12, neck portion 14 corresponds with neck portion 14, and distal portion 16 corresponds with distal portion 16. Multi-accessory mount assembly 10' differs from multi-accessory mount assembly 10 in that multi-accessory mount assembly 10' includes groove 501 disposed between proximal portion 12 and neck portion 14 for releasably engaging with interchangeable sub mount 500, as described in further detail below. As shown in FIG. 7D, neck portion 14 may include cut outs 524 to reduce the weight of the multi-accessory mount assembly. In some embodiments, cut outs 524 may extend horizontally through neck portion 14.

Interchangeable sub mount 500 may be constructed similar to interchangeable sub mounts 100, 200, and 400 described above. For example, lower portion 502 of interchangeable sub mount 500 may be configured to be removably coupled to proximal portion 12, and upper portion 506 of interchangeable sub mount 500 may be configured to be removably coupled to a firearm accessory, e.g., optic 450. Moreover, upper portion 506 may extend from lower portion 502 via middle portion 504. Middle portion 504 may contain serrations on the front or rear. Unlike interchangeable sub mounts 100, 200, and 400, as shown in FIG. 7A, interchangeable sub mount 500 may have a tapered shape such that the width of middle portion 504 decreases from lower portion 502 toward upper portion 506. For example, a proximal side of middle portion 504 may extend vertically, whereas a distal side of middle portion 504 may be angled.

In addition, as shown in FIG. 7B, interchangeable sub mount 100 may include opening 512 extending from the proximal side of middle portion 504 to the distal side of middle portion 504 for weight reduction of interchangeable sub mount 500. An iron-sight system including bar 570 and ramp 580 may be disposed within opening 512. For example, the iron sight system may be configured such that ramp 580 is set within opening 512 and rear bar 570 is within cut out 24. As will be understood by a person having ordinary skill in the art, the iron-sight system may be any other iron sight system of one or two pieces, including but not limited to post systems, bead systems, ramp systems, ring systems, or combinations of these or other iron-sight systems.

As shown in FIG. 7C, upper portion 506 may include one or more apertures 514, e.g., threaded apertures, for receiving screws that pass through corresponding apertures in the firearm accessory, e.g., optic 450, to tightly secure the firearm accessory to interchangeable sub mount 500. As shown in FIGS. 7A and 7D, interchangeable sub mount 100 may include openings 508 and 509, each extending laterally into a side of middle portion 504 for additional weight reduction of interchangeable sub mount 500. Openings 508 and 509 may be separated by a support-providing wall, such that neither openings 508 nor 509 extend completely through middle portion 504.

Figure 7E:
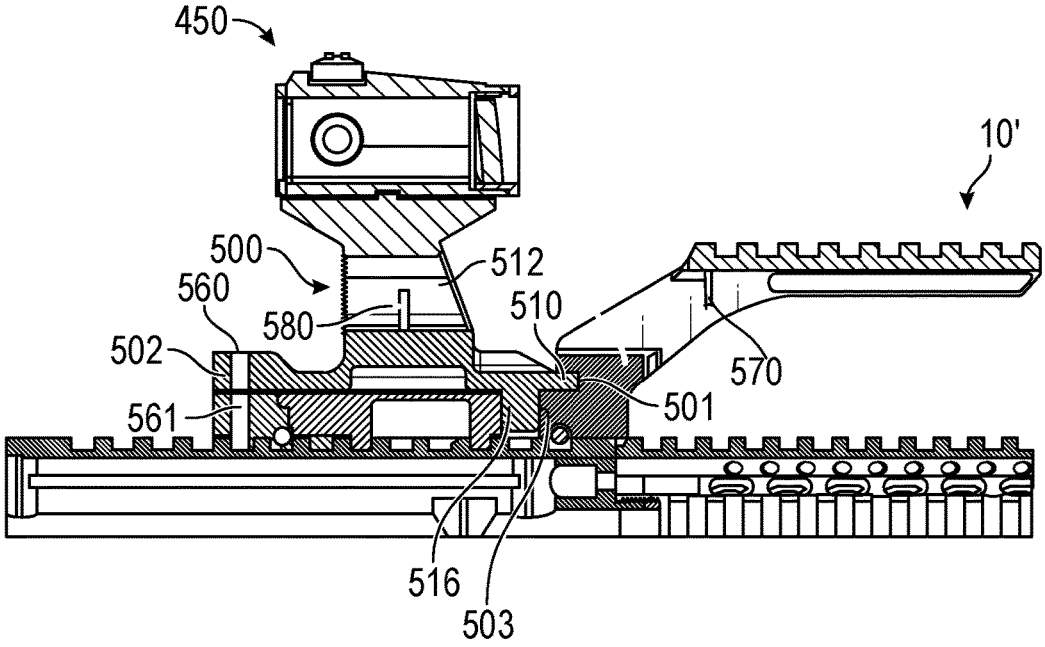
Figure 7F:
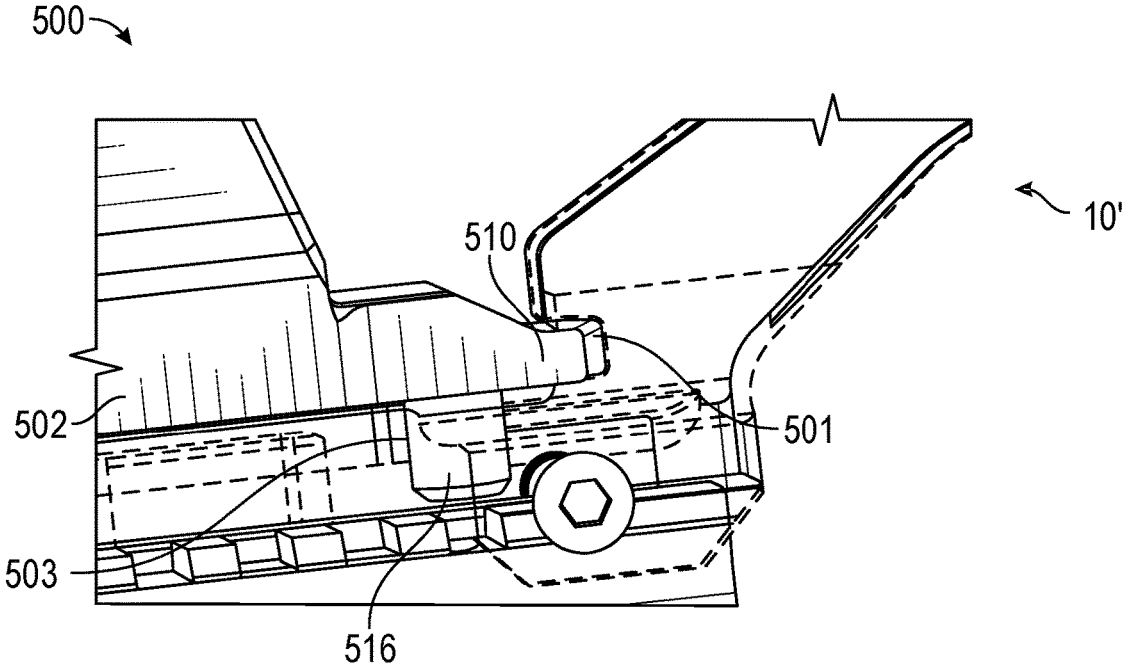
FIGS. 7F to 7H illustrate the coupling mechanism of the multi-accessory mount assembly of FIGS. 7A-7E.
Figure 7G:
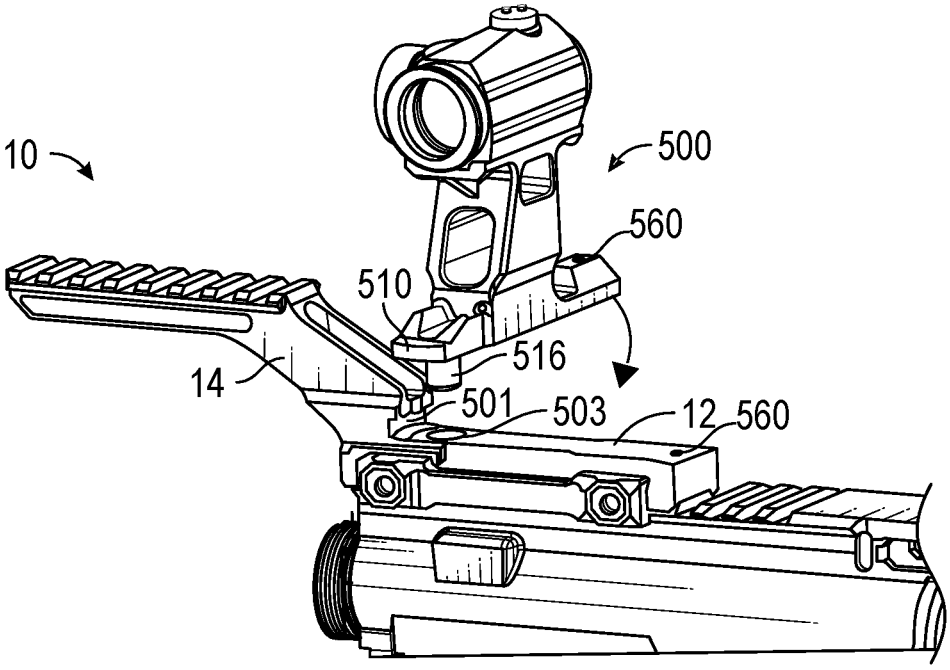
Figure 7H:
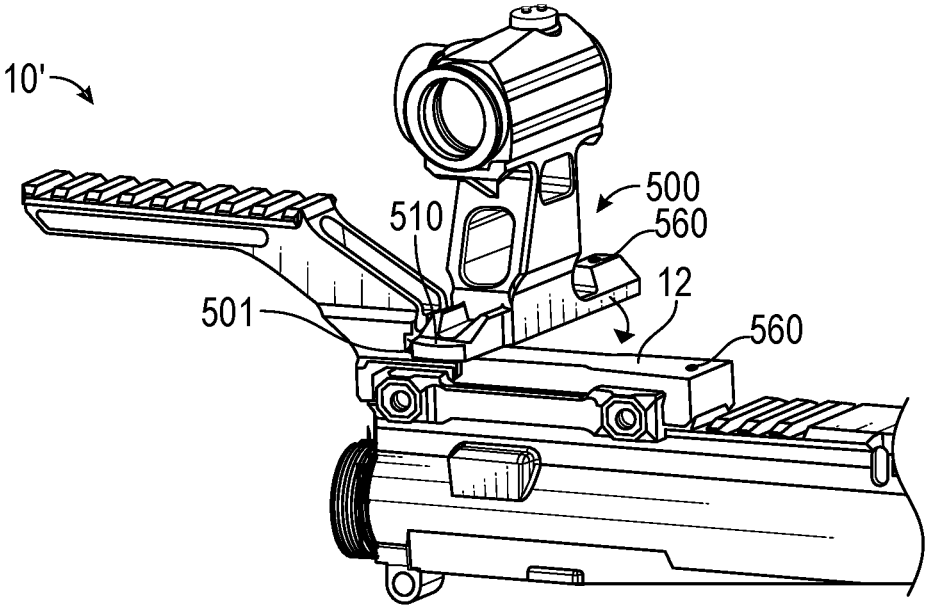

Referring now to FIGS. 7E to 7H, coupling multi-accessory mount assembly 10' to optic 450 via interchangeable sub mount 500 is described. As shown in FIG. 7E, lower portion 502 may include screw bore 560 extending through a proximal portion of lower portion 502, and proximal portion 12 may have a corresponding screw bore 561 extending at least partially therethrough, which may be aligned with screw bore 560 to facilitate securement of interchangeable sub mount 500 to proximal portion 12, e.g., via a screw. As described above, multi-accessory mount assembly 10' includes groove 501 for releasably engaging with interchangeable sub mount 500. Accordingly, as shown in FIGS. 7G and 7H, lower portion 502 of interchangeable sub mount 500 includes ridge 510 sized and shaped to be securely received by groove 501. In addition, lower portion 502 of interchangeable sub mount 500 includes pin 516 extending outwardly from the bottom surface of lower portion 502, and multi-accessory mount assembly 10' includes receptacle 503, sized and shaped to securely and pivotally receive pin 516 therein.

First, as shown in FIGS. 7G, interchangeable sub mount 500 may be positioned above and perpendicular to multi-accessory mount assembly 10', such that pin 516 is aligned with receptacle 503, and so that lowering of interchangeable sub mount 500 toward multi-accessory mount assembly 10' can be achieved without colliding ridge 510 and neck portion 14. When interchangeable sub mount 500 is in contact with multi-accessory mount assembly 10' such that pin 516 is received within receptacle 503, interchangeable sub mount 500 may then be rotated relative to multi-accessory mount assembly 10' as shown in FIG. 7H so that ridge 510 enters groove 501.

FIG. 7D illustrates when interchangeable sub mount 500 is properly aligned with multi-accessory mount assembly 10', e.g., when lower portion 502 is parallel with proximal portion 12, and screw bore 560 is aligned with screw bore 561. A screw may then be inserted to secure interchangeable sub mount 500 to proximal portion 12. The frictional forces between ridge 510 and groove 501, the frictional forces between pin 516 and receptacle 503, and the frictional forces between the bottom surface of lower portion 502 and the upper surface of proximal portion 12 may assist in securely maintaining interchangeable sub mount 500 in positioned relative to multi-accessory mount assembly 10'.

Figure 8A:
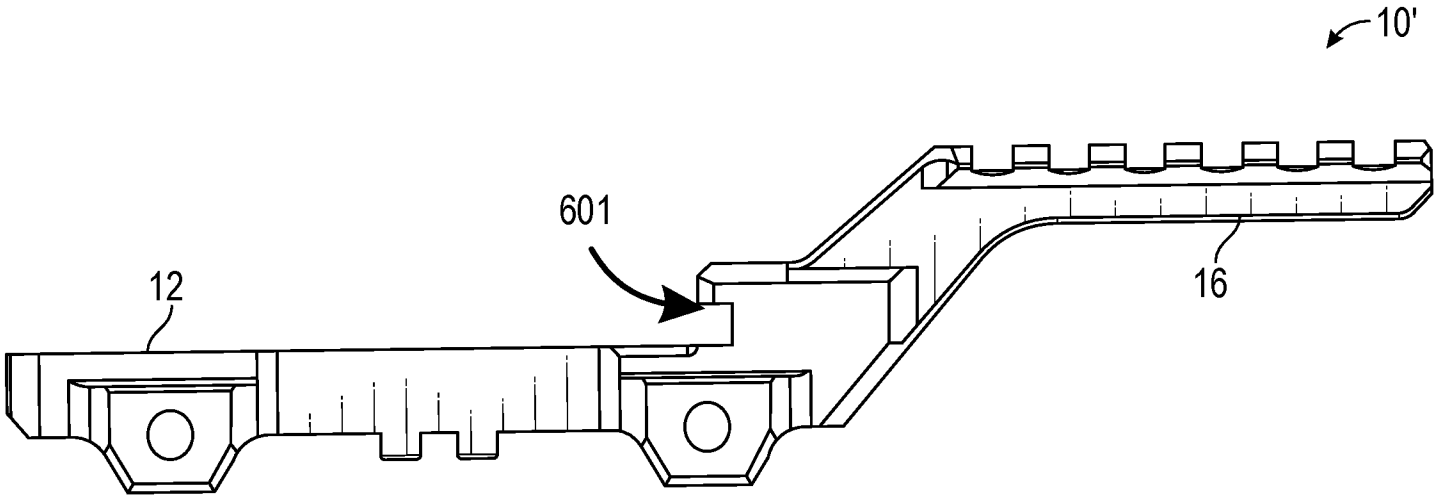
FIGS. 8A to 8C illustrate various views of another exemplary multi-accessory mount assembly in accordance with one of more embodiments of the disclosure.
Figure 8B:
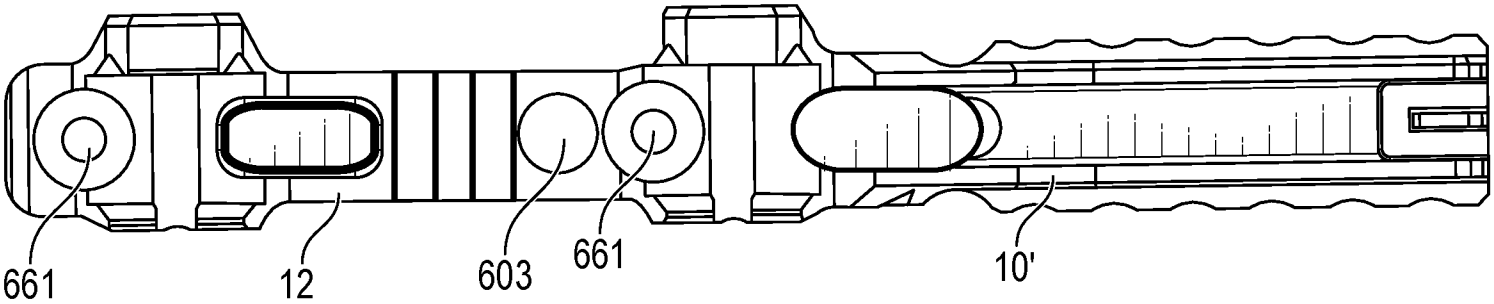
Figure 8C:
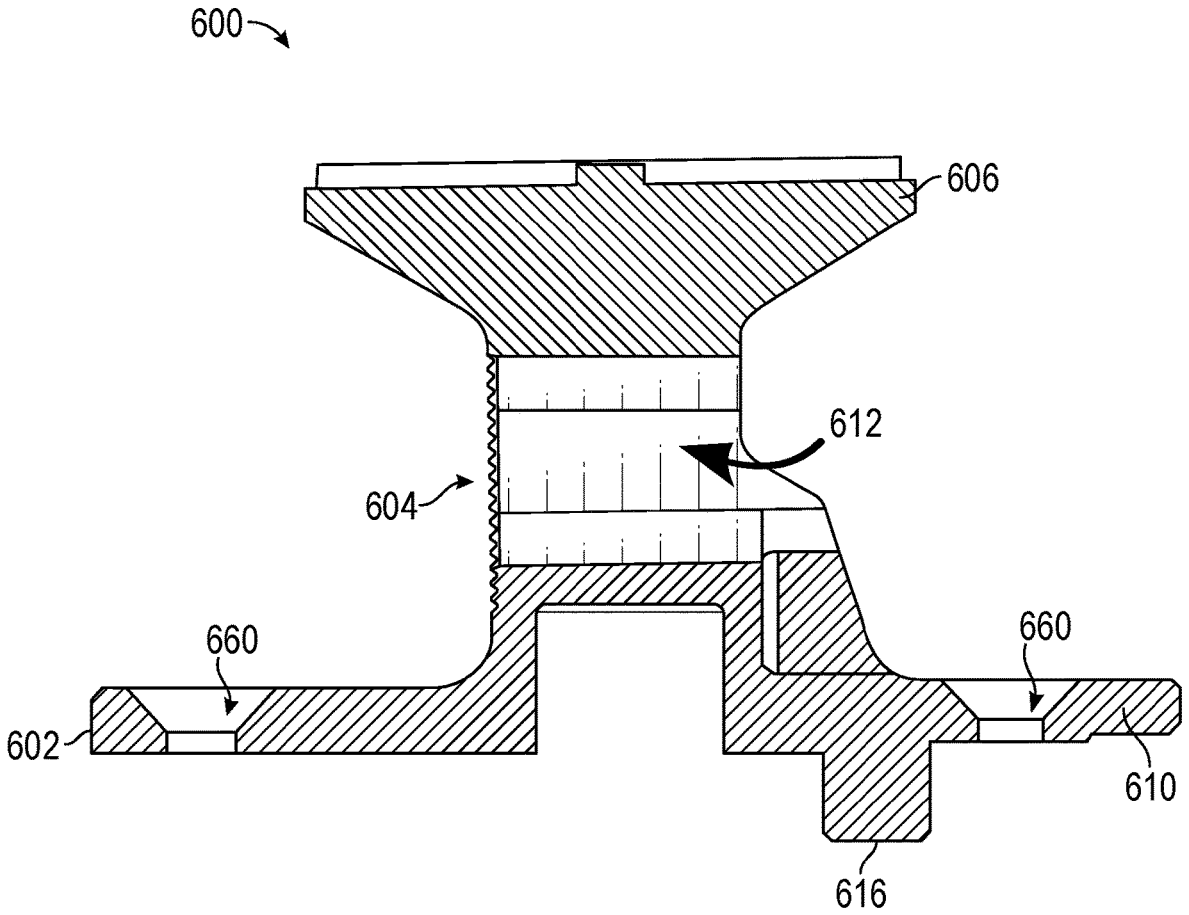

Referring now to FIGS. 8A to 8D, an alternative exemplary interchangeable sub mount for coupling with an alternative exemplary multi-accessory mount assembly is provided. FIG. 8A shows a side view of a proximal portion 12 onto which the interchangeable sub mount 600 will be mounted. FIG. 8B shows the bottom view of the proximal portion 12, including showing screw bores extending therethrough. FIG. 8C shows a cross-sectional view of the interchangeable sub mount 600.

As shown in FIG. 8A, multi-accessory mount assembly 10' may be constructed similar to multi-accessory mount assembly 10, with similar components having like prime reference numerals. For example, proximal portion 12 corresponds with proximal portion 12, neck portion 14 corresponds with neck portion 14, and distal portion 16 corresponds with distal portion 16. Multi-accessory mount assembly 10' differs from multi-accessory mount assembly 10 in that multi-accessory mount assembly 10' includes groove 601 disposed between proximal portion 12 and neck portion 14 for releasably engaging with interchangeable sub mount 600, as described in further detail below.

As shown in FIG. 8C, interchangeable sub mount 600 may be constructed similar to interchangeable sub mounts 100, 200, 400, and 500 described above. For example, lower portion 602 of interchangeable sub mount 600 may be configured to be removably coupled to proximal portion 12, and upper portion 606 of interchangeable sub mount 600 may be configured to be removably coupled to a firearm accessory, e.g., optic 450. Moreover, upper portion 606 may extend from lower portion 602 via middle portion 604. For example, a proximal side of middle portion 604 may extend vertically, whereas at least a portion of a distal side of middle portion 604 may be angled. Middle portion 604 may contain serrations on the front or rear. In addition, interchangeable sub mount 600 may include opening 612 extending from the proximal side of middle portion 604 to the distal side of middle portion 604 for weight reduction of interchangeable sub mount 600.

Lower portion 602 may include one or more screw bores 660 extending through a proximal portion of lower portion 602, and proximal portion 12 may have a corresponding screw bore 661 extending at least partially therethrough, which may be aligned with screw bore 660 to facilitate securement of interchangeable sub mount 600 to proximal portion 12, e.g., via a screw. As shown in FIG. 8C, proximal portion 12 may include two separate screw bores 660 for mounting interchangeable sub mount 600 thereupon, which may be aligned with the two screw bores 661 of proximal portion 12, as shown in FIG. 8B.

Figure 8D:
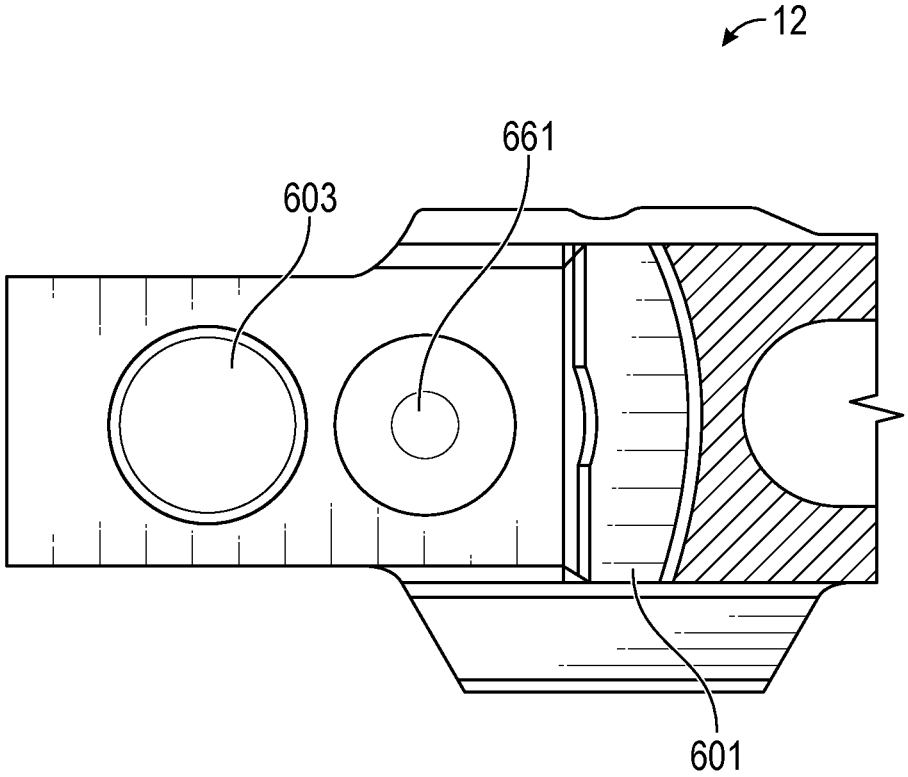
FIG. 8D is a top view of the coupling mechanism of the multi-accessory mount assembly of FIGS. 8A to 8C.

FIG. 8D shows the coupling mechanism of proximal portion 12 for securing interchangeable sub mount 600 to the proximal portion 12. As described above, multi-accessory mount assembly 10' includes groove 601 for releasably engaging with interchangeable sub mount 600. Accordingly, groove 601 is sized and shaped to securely receive ridge 610 of lower portion 602 of interchangeable sub mount 600, as shown in FIG. 8D. In addition, proximal portion 12 includes receptacle 603 sized and shaped to securely and pivotally receive pin 616 extending outwardly from the bottom surface of lower portion 602 of interchangeable sub mount 600 therein.

Figure 9:
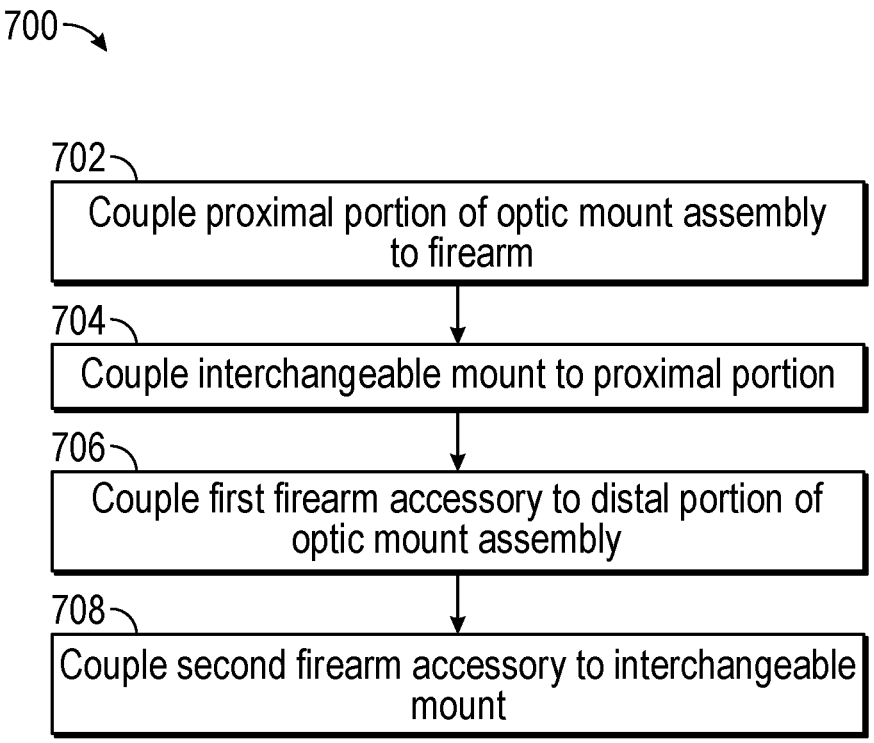
FIG. 9 is a flow chart illustrating the steps of an exemplary method for coupling a multi-accessory mount assembly to a firearm in accordance with one or more embodiments of the disclosure.

Referring now to FIG. 9, exemplary method 700 for coupling multi-accessory mount assembly 10, 10' to a firearm is provided. At step 702, proximal portion 12, 12, 12 of multi-accessory mount assembly 10, 10' may be coupled to the rail mechanism of the firearm, e.g., a Picatinny rail or a Weaver rail, via screws/knobs 28. Multi-accessory mount assembly 10, 10', 10" should be coupled to the firearm such that distal portion 16, is distal to proximal portion 12, relative to the firearm. At step 704, an interchangeable sub mount, e.g., interchangeable sub mounts 100, 200, 400, 500, 600 may be selected by the firearm operator and coupled to proximal portion 12, 12', 12" using a system of position reference features depending on which interchangeable sub mount is selected, e.g., such that groove 32 mates with ridge 110, groove 108 mates with protrusion 34, apertures 106 are aligned with apertures 26, pin 516 is received within receptacle 503, ridge 510 enters groove 501, screw bore 560 is aligned with screw bore 561, pin 616 is received within receptacle 603, ridge 610 enters groove 601, and/or screw bore 660 is aligned with screw bore 661, etc.

Screws S may be used to fix the selected interchangeable sub mount to the proximal portion. For example, when interchangeable sub mount 500 is selected, interchangeable sub mount 500 may be coupled to proximal portion 12, e.g., by engaging pin 516 and receptacle 503, rotating interchangeable sub mount 500 until ridge 516 is engaged with groove 501, and inserting screw S through screw bores 560 and 561. When interchangeable sub mount 600 is selected, interchangeable sub mount 600 may be coupled to proximal portion 12, e.g., by engaging pin 616 and receptacle 603, rotating interchangeable sub mount 600 until ridge 616 is engaged with groove 601, and inserting screws S through both screw bores 660 and both screw bores 661. At step 706, a first firearm accessory, e.g., laser 350, may be coupled to the upper surface of distal portion 16, 16', 16". At step 708, a second fire arm, e.g., optic 450 or 300, may be coupled to the upper surface of the selected interchangeable sub mount.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A multi-accessory mount assembly for use with a firearm having a muzzle end and a breech end, and a rail system extending at least partially between the muzzle end and the breach end, the assembly comprising:

a proximal portion having a base configured to be removably coupled to the rail system of the firearm and a sub mount, the sub mount having a first upper surface configured to receive a first firearm accessory, the upper surface being a first height above the base; and a distal portion coupled to the base via an angled neck portion extending away from the base in a direction toward the muzzle end of the firearm when mounted to the firearm, wherein the distal portion is spaced apart from the rail system of the firearm when mounted to the firearm, the distal portion having a second upper surface configured to receive a second firearm accessory, the second upper surface being a second height above the base;

wherein the first height is greater than the second height;

wherein a distal end of the first upper portion and the proximal end of the second upper portion include a space there between relative to a longitudinal axis of the base;

wherein, when the assembly is mounted to the firearm, the proximal portion is configured to be mounted toward the breech end of the firearm, and the distal portion is configured to be mounted toward the muzzle end of the firearm.

2. The assembly of claim 1, wherein the sub mount is interchangeable.

3. The assembly of claim 1, wherein the proximal portion is configured to be removably coupled to the base.

4. The assembly of claim 1, wherein the proximal portion comprises a first threaded aperture and the sub mount comprises a second threaded aperture configured to be aligned with the first threaded aperture, the assembly further comprising a screw configured to couple the sub mount to the proximal portion via the first and second threaded apertures.

5. The assembly of claim 1, wherein the sub mount comprises a first geometry configured to mate with a second geometry of the proximal portion.

6. The assembly of claim 5, wherein the first geometry comprises a pin and the second geometry comprises a receptacle configured to pivotally receive the pin, and wherein the sub mount further comprises a ridge configured to releasably engage with a groove between the proximal portion and the neck portion.

7. The assembly of claim 1, wherein, when the base is coupled to the firearm, a space between a lower surface of the distal portion and an upper surface of the firearm is sized and shaped to permit a support hand of an operator of the firearm to grip the firearm without interfering with a use of the second firearm accessory.

8. The assembly of claim 1, wherein the second upper surface of comprises a rail system.

9. The assembly of claim 1, wherein the sub mount and distal portion are configured to be coaxial along a length of the firearm.

10. The assembly of claim 1, wherein the sub mount extends in a substantially perpendicular direction from the proximal portion, and wherein the distal portion is parallel to the proximal portion and spaced apart from the firearm when coupled to the firearm.

11. The assembly of claim 1, wherein the sub mount extends in a substantially perpendicular direction from the proximal portion, and wherein the distal portion is vertically displaced relative to the proximal portion, and longitudinally spaced apart from the sub mount in the distal direction.

* * * * *